US007505370B2

(12) United States Patent
Rydgren

(10) Patent No.: US 7,505,370 B2
(45) Date of Patent: Mar. 17, 2009

(54) CLOCK DISPLAY

(75) Inventor: Åke Rydgren, Södra Sandby (SE)

(73) Assignee: Sony Ericsson Mobile Communications AB, Lund (SE)

( * ) Notice: Subject to any disclaimer, the term of this patent is extended or adjusted under 35 U.S.C. 154(b) by 358 days.

(21) Appl. No.: 11/419,763

(22) Filed: May 23, 2006

(65) Prior Publication Data

US 2007/0274161 A1 Nov. 29, 2007

(51) Int. Cl.
*G04B 47/00* (2006.01)
*G04C 17/00* (2006.01)
*G04C 19/00* (2006.01)

(52) U.S. Cl. ..... 368/10; 368/84; 368/223; 368/238; 368/242

(58) Field of Classification Search ..... 368/76, 368/80, 82, 84, 228, 238, 242, 10
See application file for complete search history.

(56) References Cited

U.S. PATENT DOCUMENTS 2,023,934 A * 12/1935 Moise, Jr. ..... 368/232
3,823,549 A * 7/1974 Feldman ..... 368/82
3,959,963 A * 6/1976 Murrell ..... 368/242
4,488,818 A * 12/1984 Saurer et al. ..... 368/71
4,993,005 A * 2/1991 Watanabe ..... 368/226
5,623,456 A * 4/1997 Miyamoto et al. ..... 368/226
5,697,322 A * 12/1997 Hay et al. ..... 116/286
6,515,942 B2 * 2/2003 Basturk ..... 368/223
6,600,527 B1 * 7/2003 Basturk et al. ..... 349/74
6,678,217 B2 * 1/2004 Bastruk ..... 368/84
6,903,784 B1 * 6/2005 Basturk ..... 349/2
7,016,264 B2 * 3/2006 Ueno et al. ..... 368/67
7,347,619 B2 * 3/2008 Lee ..... 368/296
2006/0120222 A1 6/2006 Mazzetti

FOREIGN PATENT DOCUMENTS

EP 0 926 574 A 6/1999
EP 1 046 086 A1 10/2000
FR 2631716 * 5/1988

* cited by examiner

*Primary Examiner*—Vit W Miska
(74) *Attorney, Agent, or Firm*—Renner, Otto, Boisselle & Sklar, LLP

(57) ABSTRACT

The invention relates to a clock display and particularly a clock display comprising a combined electronic display unit and mechanical clock hands. The clock hand has a visible state for showing the time and a transparent state used when in it is not desired to obscure the underlying display unit. The clock display may be incorporated in a portable device, such as a mobile telephone or a wrist watch.

10 Claims, 2 Drawing Sheets

CLOCK DISPLAY

FIELD OF THE INVENTION

The present invention relates to a clock display and, more particularly, to a clock display comprising a combined electronic display unit and mechanical clock hands. The clock hand has a visible state for showing the time and a transparent state used when in it is not desired to obscure the underlying display unit. The clock display may be incorporated in a portable device, such as a mobile telephone.

BACKGROUND OF THE INVENTION

Most portable devices, with an electronic display unit for displaying various information relating to the operation of the device, also incorporate a clock. Usually the time is shown on a part of the display, either as digits or as images in the form of analog clock hands.

However, many people prefer watches with mechanical clock hands to digital display systems. Even today with the currently available sophisticated digital displays, most of the wrist watches sold are provided with mechanical clock hands. However, in a portable device whose main purpose is not showing the time, mechanical clock hands will obstruct the view when the display unit is showing other information than the time.

Combined digital displays and mechanical hands are known per see. See for example EP 1046086, disclosing a watch with overlapping, separately driven mechanical and digital displays. However, in a timepiece it is not a problem that the clock hands are visible at all times.

SUMMARY OF THE INVENTION

An object of the present invention is to provide a clock display with mechanical clock hands that have both a visible state and a transparent state.

The present invention provides a clock display comprising:

an electronic display unit;

clock hands placed in front of the display unit and connected to a hand-moving mechanism;

a control unit controlling the hand-moving mechanism in cooperation with timing circuitry; wherein each clock hand has a visible state, and a transparent state.

Preferably, the display unit is adapted for non-polarized light, and the clock hands in the visible state are brought to block light, and in the transparent state are brought to pass polarized light.

In one embodiment, each clock hand essentially consists of an LCD display.

Suitably, the control unit is adapted to control the hand-moving mechanism to set the clock hands in a position dependent of the timing circuitry in both the visible state, and the transparent state.

In another embodiment, each clock hand essentially consists of two members, the two members passing polarized light in different polarization directions, the two members being adapted to overlap in the visible state and to be separated in the transparent state.

Preferably, the control unit is adapted to control the hand-moving mechanism to set the members of clock hands in a unique position independent of the timing circuitry in the transparent state.

Suitably, the members of clock hands are evenly distributed over the display unit in the unique position.

Suitably, the members of clock hands are placed as an X in the unique position.

Preferably, the clock hands are brought to the transparent state, dependent on an information display state of the display unit.

Suitably, the clock hands are brought to the visible state, when the display unit is in a time information display state.

The present invention also provides a portable device incorporating such a clock display.

The device may be a mobile telephone, a pager, a communicator, a smart phone, a wrist watch, or an electronic organiser.

BRIEF DESCRIPTION OF THE DRAWINGS

The invention will be described in detail below with reference to the accompanying drawings, in which.

DETAILED DESCRIPTION OF PREFERRED EMBODIMENTS

The present invention is applicable in portable devices, such as mobile telephones, pagers, communicators, smart phones, wrist watches, and electronic organizers. The invention is not restricted these examples.

Two embodiments of the invention will be described below. Both embodiments use light polarizers, as for example used in liquid crystal displays (LCD). As is well known, a polarizer blocks light in one polarization direction, but is transparent to light in a direction at right angle to the blocking direction. When two polarizers are overlapped, they either let light pass when their polarization directions are parallel, or block light when their polarization directions are crossed.

Figure 1:
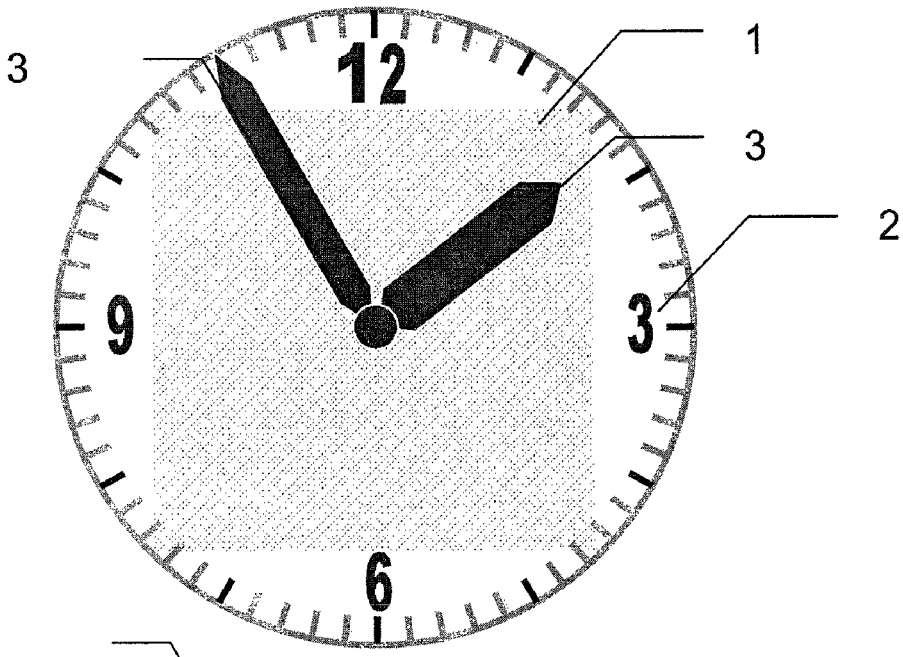
FIG. 1 is a front view of a first embodiment of the invention with clock hands visible.
Figure 2:
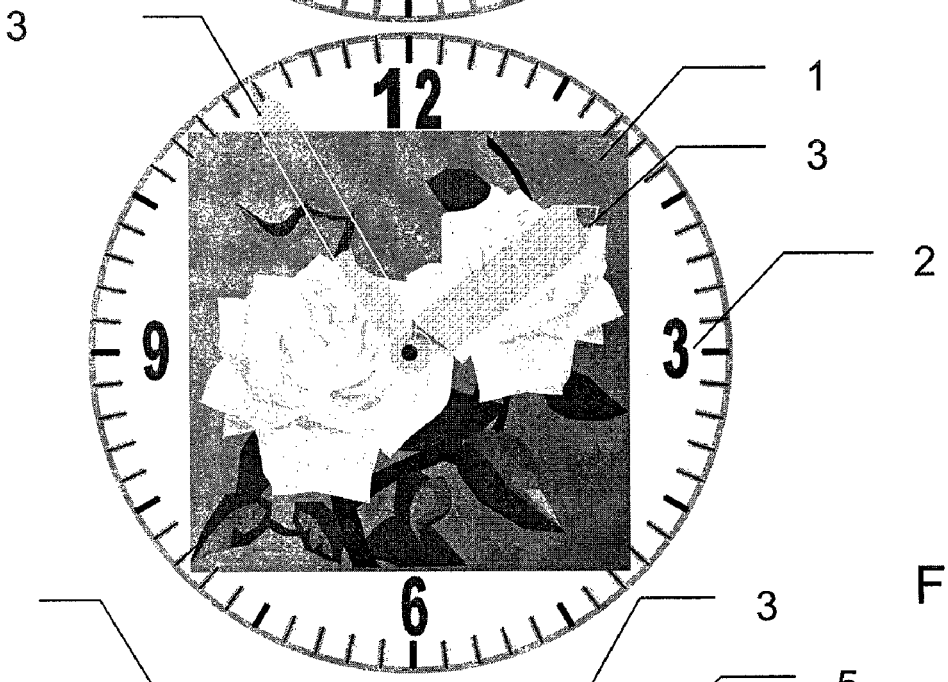
FIG. 2 is a front view of the first embodiment with the clock hands transparent.
Figure 3:
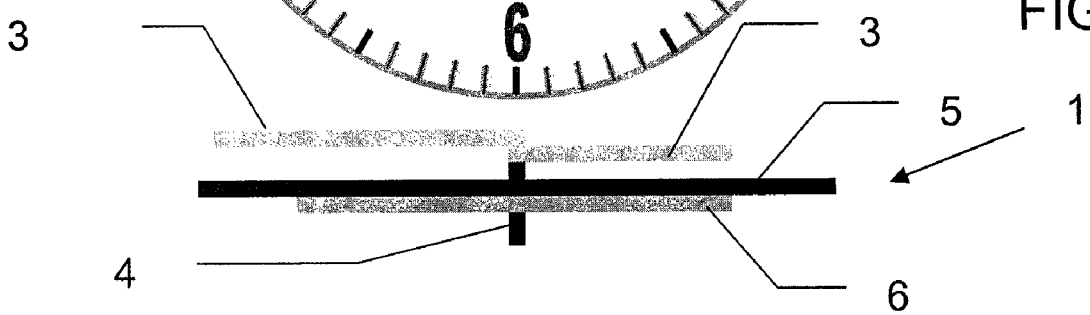
FIG. 3 is a schematic cross section view of the clock hands and display unit according to the first embodiment.

A first embodiment of the invention is shown in FIGS. 1-3. In this embodiment, each clock hand essentially consists of a liquid crystal display unit. As is known, a LCD unit comprises two polarizers with a layer of liquid crystals placed in between. By energizing or de-energizing the liquid crystals, the LCD can be brought to either block the light, which makes the display appear dark, or be brought to let light pass in a transparent state. In the transparent state, the LCD only blocks light in one polarization direction. This attenuation is almost invisible in an LCD display.

FIG. 1 shows a clock display of a first embodiment of the invention in a time displaying state. The clock display comprises a display unit 1 in an inactive state. Suitably, there is a dial 2, showing digits and minute divisions. The clock display also comprises clock hands 3, which appear dark (black) in their visible state.

FIG. 2 shows the clock display in a transparent state. Now, the display unit 1 is active, showing an image. The clock hands 3 are brought to their transparent state so that the user of the device can view the display unit 1 without the clock hands 3 obscuring any part of the display (except possibly where a drive mechanism 4 is arranged through the display unit 1 at the center).

FIG. 3 shows a transverse section of the clock display with the clock hands 3 at the top in front of the display unit 1. The display unit 1 should be of a type using non-polarized light, such that the light can pass the clock hands 3 in their transparent state irrespective of their angle and positions. A suitable color display is e.g. an organic light emitting device, OLED, comprising a transparent lid 5 and a stack 6 of display elements. OLED displays are commercially available components.

The clock hands 3 are connected by means of a hand-moving mechanism 4 of which only shafts passing the display unit 1 are shown in FIG. 3. The hand-moving mechanism 4 is controlled by a control unit, which is co-operating with timing circuitry. The control unit is adapted to set the clock hands according to the correct time when the clock display is in time display mode, but may control the clock hands independently of the timing circuitry in other modes.

In the first embodiment there is no need to move the clock hands when the display unit 1 is in an active mode displaying information not relating to the time keeping. The clock hands can be kept in a position showing the time. In an alternative embodiment, the clock hands 3 are moved to a specific position, which is selected to harmonize with other features or images shown on the display unit 1.

In order to energize the liquid crystal layer between the polarizers, electric connections are arranged through the drive shafts to the respective clock hand. In one embodiment, two poles are arranged through the shaft to each clock hand. In another embodiment, one pole is arranged trough the shaft, while the other pole has a contact point at the tip of the clock hand. In this case, the clock hand should be moved to a specific position to make contact in order to control the liquid crystals to achieve the transparent state.

Figure 4:
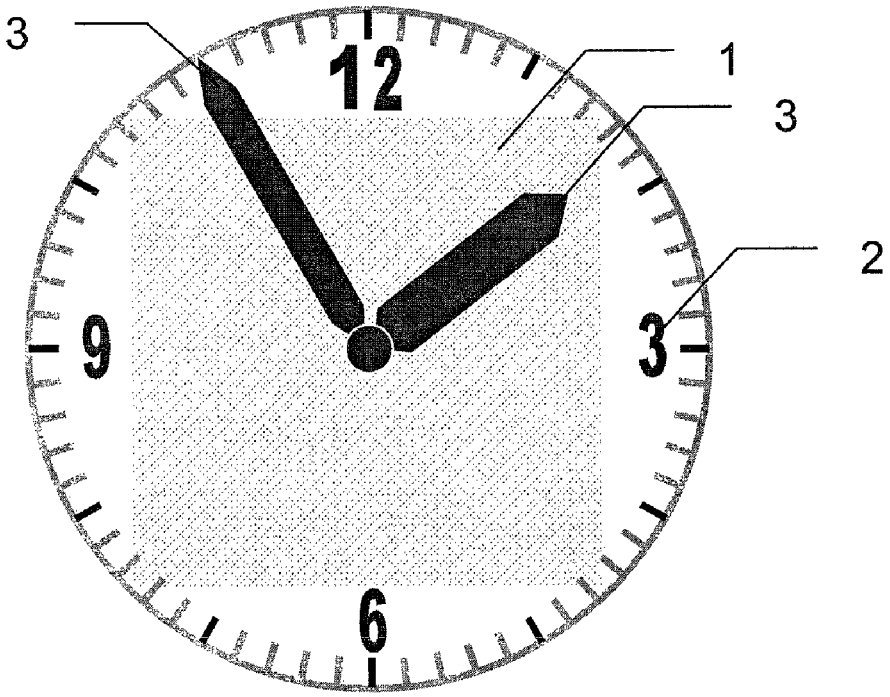
FIG. 4 is a front view of a second embodiment of the invention with clock hands visible.
Figure 5:
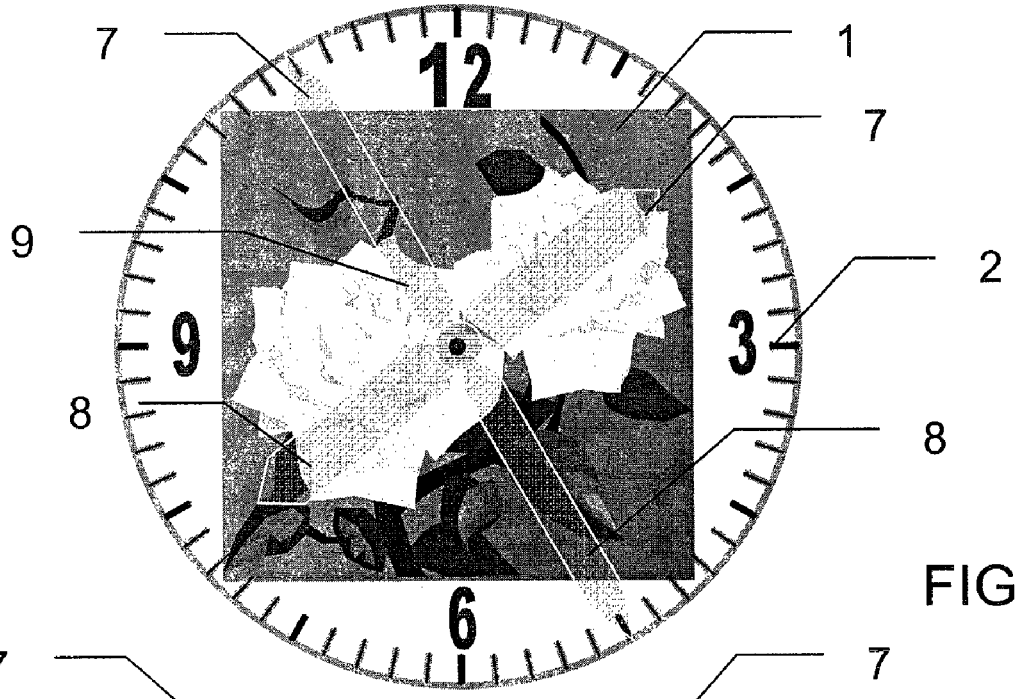
FIG. 5 is a front view of the second embodiment with the clock hands transparent.
Figure 6:
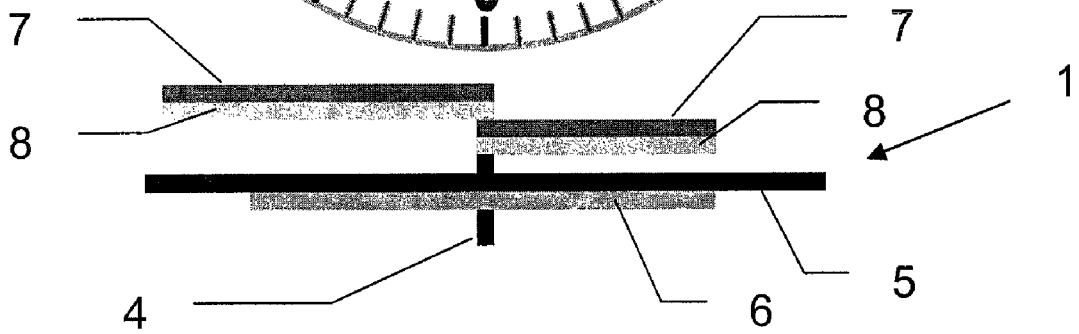
FIG. 6 is a schematic cross section view of the clock hands and display unit according to the second embodiment.

A second embodiment of the invention is shown in FIGS. 4-6. Like reference numerals are used for similar components. In the second embodiment, each clock hand 3 comprises two members, each essentially consisting of a polarizer. As may be seen from FIG. 6, each clock hand 3 comprises an upper member 7 and a lower member 8. When the two members are overlapping, as shown in FIG. 4, the polarization directions of the polarizers are arranged at right angles to each other, thus blocking the light.

FIG. 5 shows the transparent state of the clock display. In this state, the upper member 7 and lower member 8 of each clock hand has been separated from each other. Thus, each clock hand member 7 and 8 only blocks light in one polarization direction, and appears as practically transparent. Suitably, all the clock hand members 7 and 8 are brought to a unique position 9. This position is independent of the actual time, and suitably the clock hand members 7 and 8 are distributed evenly over dial. In case of one hour hand and one minute hand with two members 7, 8 each, the members are suitably placed like an X.

The dial 2 itself may be provided as a monochrome LCD display, arranged in a ring substantially outside the display unit 1. Such an LCD display is very little power consuming, so that the dial 2 may be displayed permanently. Like some watches, the digits and divisions of the dial may be omitted completely.

In some time keeping situations, e.g. if the device is used as a stop watch, the display unit 1 may also be used for showing time information. In this case, the clock hands 3 may be brought to a visible or transparent state depending on the situation. The state of the clock hands may be controlled automatically by the control unit and/or manually by the user overriding any default settings.

The foregoing description of the preferred embodiments of the invention has been presented for purposes of illustration and description. It is not intended to be exhaustive or to limit the invention to the precise forms disclosed, since many modifications or variations thereof may be possible in light of the above teaching. It is therefore the intention that the following claims should not be given a restrictive interpretation but should be viewed to encompass variations and modifications that are derived from the disclosed subject-matter.

The invention claimed is:

1. A clock display comprising:

an electronic display unit;

clock hands placed in front of the display unit and connected to a hand-moving mechanism, wherein each clock hand essentially consists of an LCD display and has a visible state and a transparent state, and the display unit is adapted for non-polarized light, and the clock hands in the visible state are brought to block light and in the transparent state are brought to pass polarized light; and a control unit controlling the hand-moving mechanism in cooperation with timing circuitry.

2. A clock display according to claim 1, wherein the control unit is adapted to control the hand-moving mechanism to set the clock hands in a position dependent of the timing circuitry in both the visible state, and the transparent state.

3. A clock display according to claim 1, wherein each clock hand essentially consists of two members, the two members passing polarized light in different polarization directions, the two members being adapted to overlap in the visible state and to be separated in the transparent state.

4. A clock display according to claim 3, wherein the control unit is adapted to control the hand-moving mechanism to set the members of clock hands in a unique position independent of the timing circuitry in the transparent state.

5. A clock display according to claim 4, wherein the members of clock hands are evenly distributed over the display unit in the unique position.

6. A clock display according to claim 5, wherein the members of clock hands are placed as an X in the unique position.

7. A clock display according to claim 1, wherein the clock hands are brought to the transparent state, dependent upon an information display state of the display unit.

8. A clock display according to claim 1, wherein the clock hands are brought to the visible state, when the display unit is in a time information display state.

9. A portable device comprising a clock display comprising:

an electronic display unit;

clock hands placed in front of the display unit and connected to a hand-moving mechanism; and a control unit controlling the hand-moving mechanism in cooperation with timing circuitry;

wherein each clock hand essentially consists of an LCD display and has a visible state, and a transparent state.

10. A portable device according to claim 9, wherein the device is a mobile telephone, a pager, a communicator, a smart phone, a wrist watch, or an electronic organiser.

* * * * *